United States Patent [19]

Carrington et al.

[11] 4,248,543

[45] Feb. 3, 1981

[54] FINGER PRINT POWDER DISPENSING APPARATUS

[75] Inventors: John H. Carrington; Herman Rudolph, both of Raleigh, N.C.

[73] Assignee: Sirchie Finger Print Laboratories, Inc., Raleigh, N.C.

[21] Appl. No.: 11,783

[22] Filed: Feb. 14, 1979

[51] Int. Cl.[3] ..... B43M 11/06

[52] U.S. Cl. ..... 401/183; 401/269

[58] Field of Search ..... 401/183, 143, 152, 269, 401/117, 175; 132/82 G

[56] References Cited

U.S. PATENT DOCUMENTS

| | | | |
|---|---|---|---|
| 954,133 | 4/1910 | Reed | 401/269 X |
| 1,065,879 | 6/1913 | Krebs | 401/117 X |
| 1,067,596 | 7/1913 | Fesler | 401/269 X |
| 1,426,909 | 8/1922 | Rayder | 401/183 |
| 1,571,556 | 2/1926 | Hyhagen | 401/117 X |
| 1,626,992 | 5/1927 | Willk | 401/117 |
| 1,639,388 | 8/1927 | Stebbings | 401/117 X |
| 1,659,800 | 2/1928 | Bailey | 401/117 X |
| 3,485,563 | 12/1969 | Chennell | 401/183 |

FOREIGN PATENT DOCUMENTS

| | | | |
|---|---|---|---|
| 599500 | 7/1934 | Fed. Rep. of Germany | 401/183 |

*Primary Examiner*—John D. Yasko

*Attorney, Agent, or Firm*—Edward M. Farrell

[57] ABSTRACT

Finger print dispensing apparatus includes a compact manually operated portable unit. The unit includes a detachable brush for spreading the powder dispensed, a squeezable detachable container for holding the powder and a nozzle arrangement for delivering the powder to the brush when the container is squeezed. An extendible and retractable sleeve is provided to either house and shape the brush during non use or to expose the brush during use. Moisture proof means are provided on the sleeve to house the brush and keep the powder in the container dry when the apparatus is not in use.

9 Claims, 5 Drawing Figures

FIG. 1
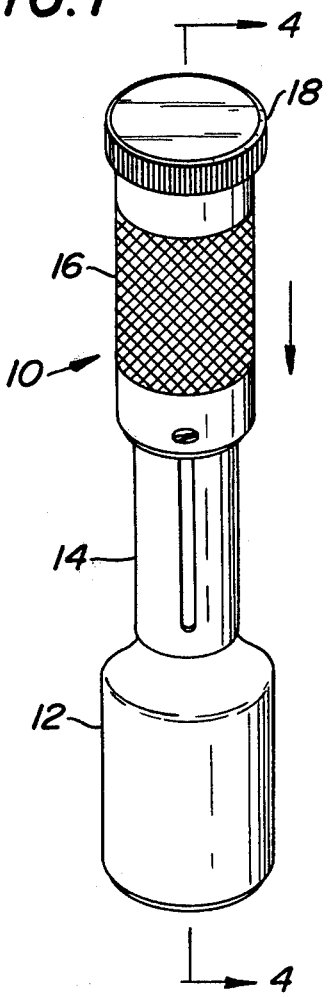
FIG. 2
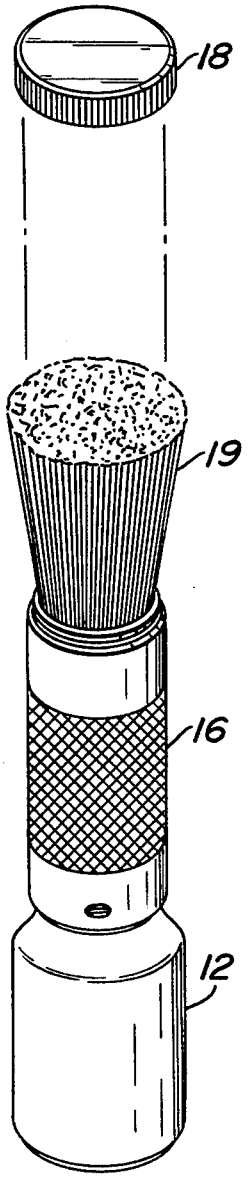
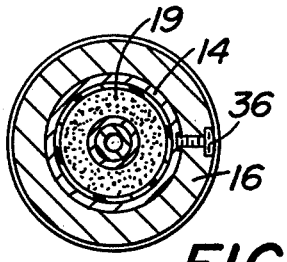
FIG. 5

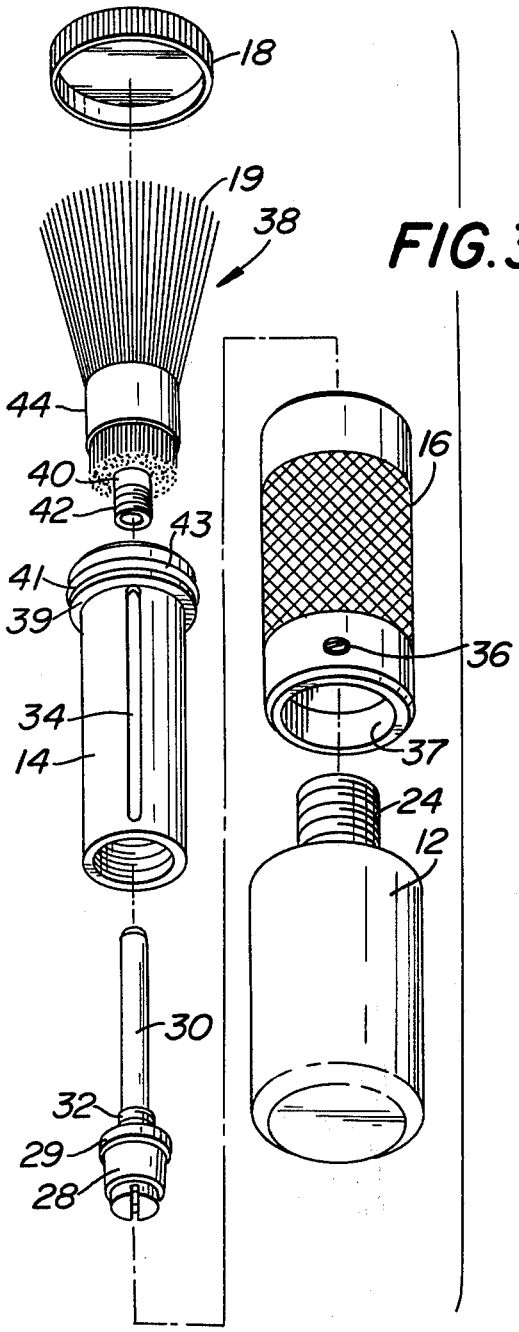
FIG. 3
FIG. 4
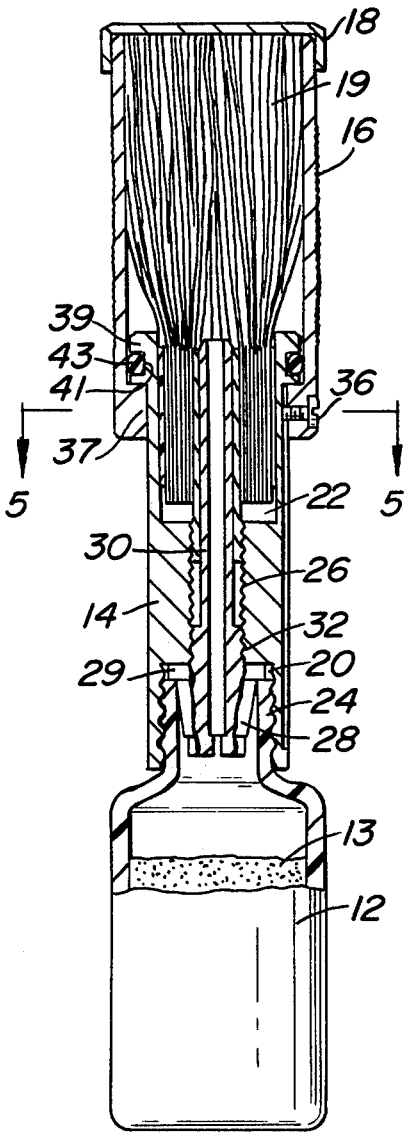

FINGER PRINT POWDER DISPENSING APPARATUS

The use of finger print powders for locating and developing latent finger prints is well known. Such latent print powders must generally be homogeneous, sensitive to secretions, have good adherent qualities and reproduction capabilities. The powders may be black for good photographic and contrast or other colors for use on multi-colored surface. The powders may have different characteristics, for example, may be magnetic or be fluorescent when exposed to ultra-violet light.

Finger print powders have been applied to surfaces by means of brushes, sprays and the like. After application of the powders, the excess powder has been removed by brushes or magnetic means.

Devices for storing powders, applying it to a surface, and removing the excess from the surface have generally involved separate units. While some attempts have been made to provide integral units in connection with latent finger print powders, in the main, they have been large, cumbersome, inconvenient to use, or deficient in some other respect. While various compact devices have been used in various other fields involving the use of liquids, shaving cream and the like, such devices have not been suitable for use with latent finger print powders with maximum utility and efficiency.

Finger print powders must generally be of high density from 0.5 to 2.0 g/ml with the particle sizes ranging from 20 U to 128 U. Also, the powder must be kept free from moisture. For this reason, it is essential that any compact device for storing, applying and removing excess powder must be moisture proof between uses.

In addition to being moisture proof, it is desirable that any compact device for storing, dispensing and removing excess powder should be readily portable and easily carried by an operator. Its use must be fast and convenient and small enough to be easily pocketed so as not to interfere with other activities of the operator.

In order to provide maximum efficient use of the device, it is desirable to use brushes having bristles with high delicacy and durability. This permits the bristles to remove the excess powder from between the ridges of the latent finger print. It is desirable, for example, that such brushes, for example, should not only be very thin and flexible, but also be capable of holding the finger print powder in the bristles so that replenishment of the powder is not continuously required. Such brushes should be soft and inhibit scratching the surfaces of a latent print. Brushes including thousands of fiberglass filaments or bristles have been used. These bristles tend to spread out in a cluster during use. When not in use, however, it is important that the bristles be reshaped between uses and be stored in a moisture proof container between uses because of the powder which may be stored between the bristles.

Finally, in order to provide a compact, portable device of the type described to be used efficiently it is important the means for supplying the powder be readily replaceable when empty. Also, convenient means for removing and replacing the brush periodically should be provided without having to change or replace other items.

Some patents relating to the general subject matter of the present invention include U.S. Pat. Nos. 3,106,741; 2,750,615; 1,170,923; 1,658,542 and 1,425,242.

It is an object of this invention to provide a small, compact, manually operated device for dispensing latent finger print powder.

It is still a further object of this invention to provide a portable, improved self contained unit for dispensing latent finger powder including a brush, a container for holding powder and means for supplying the powder to the brush.

It is still a further object of this invention to provide an improved portable self contained unit for dispensing latent finger print powder including a brush assembly for holding the powder, and means for supplying the powder from the container to the brush in which the brush assembly or container is readily removable to permit easy replacement.

It is still a further object of this invention to provide an improved portable self contained apparatus including a brush, powder container and means for manually supplying the powder from the container to the brush, in which means are provided for maintaining the shape of the brush between uses.

It is still a further object of this invention to provide improved self contained portable apparatus including brush powder container and means for supplying the powder from the container to the brush in which the powder is maintained moisture free between uses.

It is still a further object of this invention to provide an improved portable self contained apparatus having a brush, container, and means to supply the powder from the container to the brush, in which the brush bristles spread out during use and reshaped between uses with the bristles being capable of holding powder therebetween.

In accordance with the present invention, a portable self contained finger print powder dispensing apparatus includes a brush assembly, a manually squeezable container for holding powder, and an elongated cylindrical member having an opening therein for supplying powder from the container to the brush when the container is squeezed. A hollow sleeve member is movably mounted on the cylindrical member and disposed to be extended or retracted in an axial direction to upper and lower positions on the cylindrical member. The sleeve houses the bristles of the brush when extended to its upper position and exposes the bristles for use when it is retracted to a lower position. A closure is dimensioned to close the open end of the sleeve member in its upper position to provide a moisture proof barrier for the enclosed brush and powder.

Other objects and advantages of the present invention will be apparent and suggest themselves to those skilled in the art, from a reading of the following specification and claims, taken in conjunction with the accompanying drawing, in which:

FIG. 1 is an assembled view of a finger print powder dispensing device in a closed or inoperative position, in accordance with the present invention;

FIG. 2 is a view of the same device illustrated in FIG. 1 in an open or operative position;

FIG. 3 is an exploded view of the device illustrated in FIGS. 1 and 2;

FIG. 4 is a cross-sectional view taken along lines 4—4 of FIG. 1; and FIG. 5 is a cross-sectional view taken along lines 5—5 of FIG. 4.

Referring particularly to FIGS. 1 and 2, a finger print dispensing apparatus 10 comprises a flexible container 12 for holding the powder to be dispensed. The flexible container 12 is suitably attached to a cylindrical member 14, the details of which will be described in connection with FIGS. 3 and 4. A sleeve 16, which may be knurled, is disposed to slide up and down on the cylindrical member 14. In its upper position, as illustrated in FIG. 1, the sleeve 16 houses a brush 19 therein. A knurled cap 18 is adapted to be fitted over the sleeve 16 when it is in an extended position.

When the cap 18 is removed and the sleeve 16 is moved downwardly into a retracted position, as illustrated in FIG. 2, the brush 19 is exposed and is ready for use. FIG. 1 therefore illustrates the finger print dispensing apparatus between uses whereas FIG. 2 illustrates the apparatus during use.

The flexible container 12 is adapted to receive fine powder 13 (FIG. 4) which is delivered to the brush 19 to be applied to the latent finger print area by means to be described. The container 12 is squeezed by an operator and powder 13 is forced through an opening in the cylindrical member 14 into the bristles of the brush 19. The powder in the brush may then be conveniently brushed onto the surface involved.

Referring to FIGS. 3, 4, and 5, along with FIGS. 1 and 2, the various details of the finger print apparatus 10 are illustrated. The cylindrical member 14 includes recesses 20 and 22. These recesses 20 and 22 extend into opposite ends of the cylindrical member 14. A threaded connected central opening 26 extends through the center or axis of the cylindrical member 14 between the recesses 20 and 22.

The container 12 includes an open threaded neck portion 24. A connecting element 28 shaped to guide the inner area of the neck portion 24 includes a tube or nozzle canal 30 secured therethrough by any suitable means. As illustrated in FIGS. 3 and 4, the tubular nozzle 30 includes a threaded portion 32. The element 28 includes a top section 29 to sealingly engage the top of the neck portion 24 of the container 12 to provide an air tight and moisture proof seal. When assembled, the tubular nozzle 30 is guided by a guide tubular member 40 into the bristles of the brush 19.

The bottom portion of the sleeve 16 includes an inwardly extending projection or ring 37. The cylindrical member 14 includes an upper outwardly extending projection or ring 39. The projection 39 includes a circular groove 41 to receive an O-ring 43 therein (FIG. 4). The projections 37 and 39 provide means for limiting the extended movement of the sleeve 14 when it is in an upper or extended position with respect to the cylindrical member 14. The projections 37 and 39 also provide sealing means and means for maintaining the relative axial positions of the sleeve and cylindrical member during the movement therebetween.

While the steps of the assembly may vary somewhat, the first step generally involves the insertion of the sleeve 16 over the cylindrical member 14, after the "O" ring 43 has been inserted in the groove 41. The cylindrical member 14 includes an elongated groove 34 recessed therein which serves as a guide for the movement of a screw 36. The bottom of the sleeve 16 includes an opening having the screw 36 extending therethrough. After the sleeve 16 is positioned around the cylindrical member 14, the screw 36 is lined up with the guide recess or groove 34 and then inserted into place. The screw 35 extends into the recess 34 to permit axial movement of the sleeve 16 with respect to the member 14 while restricting any relative rotational movement therebetween. The bottom ends of the groove 34 limit the up and down movements of the screw 36 and consequently also limits the up and down movements of the sleeve 16.

After the sleeve 16 has been assembled on the cylindrical member 14, the tubular nozzle 30 with its associated part 28 and other parts are connected to the container 12. The tubular nozzle 30 is then inserted through the bottom threaded recess 20 of the cylindrical member 14. The threaded portion 32 of the tubular nozzle 30 is threaded into the central opening 26 of the member 14 with the tubular nozzle extending into the guide element within the bristles of the brush. The container 12, guided by the element 28, is then threadedly attached to the threaded bottom recess 20 of the member 14. The connections are made sufficiently tight so that moisture and air proof seals are provided by the seal 29.

Following the attachment of the container 12 to the cylindrical member 14 (or prior to it), the brush assembly 38 including the brush 19 is ready to be assembled. The brush assembly 38 comprises a tubular guide member 40 having a threaded end portion 42. The tubular member 40, which receives the tubular nozzle 30 therein, extends into the bristles of the brush 19 to the area from which the powder is to be delivered. The bristles of the brush 19 and the tubular member 40 are held in place by a sleeve ring 44. The assembly 38 is inserted into the top recess 22 of the cylindrical member 14 and threaded portion 42 of the tube 40 is threadedly secured to the central opening 26 of the cylindrical member 14. The tubular guide member 40 and the tubular nozzle 30 are mounted concentrically with respect to each other, the tubular nozzle 30 being of the smaller diameter.

After assembly, the sleeve 16 may be extended upwardly to the position illustrated in FIG. 1 with the cap 18 inserted thereon when the apparatus is not in use. When it is desired to use the apparatus, the cap 18 is taken off the sleeve 16 and the sleeve 16 is moved downwardly to a retracted position over the cylindrical member 14 as illustrated in FIG. 2. The downward movment of the sleeve 16 is limited by the lock screw 36 contacting the bottom end of the slot 34.

When the sleeve 16 is retracted downwardly, as illustrated in FIG. 2, the apparatus is ready for use. An operator may then squeeze the bottle 12 to inject powder into the bristles of the brush 19. The powder in the container 12 is brought through a nozzle like arrangement which comprises the tubes 30 and 40 into the central areas of the bristles of the brush 19. Powder is brought through the nozzle because of the effect of a current of air which is produced by the pressure on the container 12. Collapse of the container 12 causes the air confined therein to force a portion of the powder 13 through the nozzle 30 and tube 40 into the bristles of the brush.

After the powder 13 from the container 12 is forced through the tubes 30 and 40 into the bristles of the brush 19, the powder in the bristles may then be applied to a surface including a latent finger print by lightly sweeping the brush across the area involved. The bristles of the brush 19 are made of fiberglass and capable of holding small quantities of powder therebetween. The relatively thin bristles of the brush 19 cause them to form clusters and provide a very soft and fine surface for sweeping away the excess powder. This is important because the spaces where the powder must be removed between the ridges of the finger print are so narrow. If the bristles were made too wide or coarse, for example, the bristles would ride over the ridges and not sweep away the powder therebetween. The relatively soft brushes avoid scratching the surfaces of the ridges of the print.

When the sleeve 16 is extended after use, the cap 18 is put on the open end to provide a closure. The cap 18 provides a relatively tight fit over the end opening of the sleeve 16 to provide moisture proofing. In addition, the gasket 43 disposed in the groove 41 of the ring 39 provides a seal between the annular projection 39 of the cylindrical member 14 and the inner surface of the sleeve 16.

The moisture proofing provided by the cap 18, the gasket 39 and other tight fitting is important because some powder dispensed from the container 12 will generally be present in the fiberglass bristles after use.

Among the important features of the present invention is that the device is relatively small and compact. An operator may carry it as a conventional tool in his pocket. He is able to dispense powder and to take latent finger prints without going through a number of complicated steps. The operation is relatively clean because the operator is not directly exposed to the powder involved.

Other features of the invention involve the ease of assembly of the parts and easy replacement of parts after much use. For example, the container 12 may be easily screwed off the bottom threaded recess 20 of the cylindrical member 14. The threaded portion 32 of the tube 30 maintains the tube 30 in place along with the gasket 28. Consequently, when the powder in the container 12 is gone, it may be easily replaced with a new container. In addition, if the brush 19 becomes too worn or if it is desired to put on brushes of different types, the assembly 38 is easily removable by means of unscrewing the threaded connection 42 from the central threaded portion 36 of the cylindrical member 14. It is noted that the tubular guide element 40 within the brush is necessary to provide means for easy insertion of the tubular nozzle 30, especially when replacement of the brush is required.

What is claimed is:

1. A finger print powder dispensing apparatus comprising:

(a) a brush assembly including a brush having very fine bristles capable of holding said finger print powder and a tubular guide element extending into the bristles thereof.

(b) a tubular nozzle, (c) a one piece connecting member having an opening extending therethrough, said connecting member having a first recess in one end, a second recess on the other end including internal thread means, and a reduced diameter threaded central opening connecting said first and said second recess, (d) cooperating thread means on said tubular nozzle for mounting said tubular nozzle within said threaded central opening of said connecting member, (e) means for mounting said brush assembly in said first recess of said connecting member with said tubular nozzle extending through said connecting member into said tubular guide element, (f) a flexible moisture proof container for holding said powder having an opening therein, (g) thread means on said container for cooperating with said internal threads of said second recess of said connecting member to direct powder from said flexible container through said tubular nozzle into the bristles of said brush when said flexible container is manually squeezed, (h) a sleeve member movably mounted on said connecting member and disposed to be extended or retracted with respect thereto, (i) said sleeve member being disposed to surround the bristles of said brush when extended and to expose said bristles when retracted, and (j) means for enclosing said brush when said sleeve member is extended.

2. Powder dispensing apparatus as set forth in claim 1 wherein said brush assembly includes a ring element for holding in place the bristles of said brush with said tubular element and said brush assembly is partly inserted into one of said recesses and said tubular element is attached to said cylindrical member.

3. Powder dispensing apparatus as set forth in claim 2 wherein said tubular nozzle is connected in the other of said recesses in said cylindrical member.

4. Powder dispensing apparatus as set forth in claim 3 wherein the opening in said container is provided by a neck portion, with said neck portion being connected into the other of said recesses in close proximity to said tubular nozzle.

5. Powder dispensing apparatus as set forth in claim 4 wherein said cylindrical member includes a longitudinally extending outer groove therein for guiding and limiting movement of a screw extending through said sleeve member.

6. Powder dispensing apparatus as set forth in claim 5 wherin said cylindrical member and said sleeve member include protruding portions to provide stop and guide elements when said cylindrical and sleeve members are moved relative to each other.

7. Powder dispensing apparatus as set forth in claim 6 wherein a seal ring is provided in a groove of the protruding portion of said cylindrical member in sealing engagement with the inner surface of said sleeve member.

8. Powder dispensing apparatus as set forth in claim 7 wherein said tubular nozzle includes a guide portion extending into the neck portion of said container.

9. Powder dispensing apparatus as set forth in claim 8 wherein a top seal ring is provided between the top of the neck portion of said container and said cylindrical member.

* * * * *